US011576486B2

(12) United States Patent
Parker

(10) Patent No.: US 11,576,486 B2
(45) Date of Patent: Feb. 14, 2023

(54) MULTIDIRECTIONAL WALL MOUNTED STORAGE PANEL

(71) Applicant: Noble Industries Inc., Noblesville, IN (US)

(72) Inventor: Gregory Scott Parker, Sheridan, IN (US)

(73) Assignee: Noble Industries Inc., Noblesville, IN (US)

( * ) Notice: Subject to any disclaimer, the term of this patent is extended or adjusted under 35 U.S.C. 154(b) by 0 days.

(21) Appl. No.: 17/444,217

(22) Filed: Aug. 2, 2021

(65) Prior Publication Data

US 2021/0353055 A1 Nov. 18, 2021

Related U.S. Application Data

(63) Continuation of application No. 16/587,904, filed on Sep. 30, 2019, now abandoned.

(51) Int. Cl.
*A47B 57/40* (2006.01)
*A47F 5/08* (2006.01)

(52) U.S. Cl.
CPC ..... *A47B 57/40* (2013.01); *A47F 5/0823* (2013.01)

(58) Field of Classification Search
CPC ..... A47F 5/0823; A47B 57/40
See application file for complete search history.

(56) References Cited

U.S. PATENT DOCUMENTS 2,551,539 A 5/1951 Horton
2,769,553 A 11/1956 Horton
2,814,894 A 12/1957 Horton
2,942,364 A 6/1960 Horton
2,974,918 A 3/1961 Voigtlander
3,014,597 A 12/1961 McWherter
3,255,987 A 6/1966 Gatch
3,310,271 A 3/1967 King
3,452,959 A 7/1969 Ishikawa
3,871,608 A 3/1975 Ogden
4,167,261 A 9/1979 Bartels
4,265,038 A 5/1981 Crossien
(Continued)

FOREIGN PATENT DOCUMENTS

DE 3408077 C1 2/1985
EP 2 767 193 A1 8/2014
(Continued)

OTHER PUBLICATIONS

English Abstract of JP2009-142639 A (1 page).
(Continued)

*Primary Examiner* — Stanton L Krycinski
(74) *Attorney, Agent, or Firm* — Woodard, Emhardt, Henry, Reeves & Wagner, LLP

(57) ABSTRACT

A storage panel for mounting items using a plurality of brackets includes a planar mounting surface having a longitudinal axis and a latitudinal axis. The storage panel includes a means for securing the storage panel to a wall or another substantially vertical surface. An array of spaced apart mounting slots extends through the mounting surface. The array of mounting slots includes longitudinal mounting slots and latitudinal mounting slots. The longitudinal mounting slots are arranged to be parallel to the longitudinal axis of the mounting surface. The latitudinal mounting slots are arranged to be parallel to the latitudinal axis of the mounting surface.

18 Claims, 13 Drawing Sheets

(56) References Cited

U.S. PATENT DOCUMENTS

| | | | |
|---|---|---|---|
| RE31,141 | E | 2/1983 | Bartels |
| 4,406,374 | A | 9/1983 | Yedor |
| 4,860,905 | A | 8/1989 | Schott et al. |
| 4,932,538 | A | 6/1990 | Gambello |
| 5,379,976 | A | 1/1995 | DeGirolamo |
| 5,531,415 | A | 7/1996 | Kallemeyn |
| 5,556,068 | A | 9/1996 | Gorelik |
| 6,003,685 | A | 12/1999 | Malin |
| 6,199,706 | B1 | 3/2001 | Shea |
| 6,499,608 | B1 | 12/2002 | Sterling et al. |
| 6,929,131 | B1 | 8/2005 | Landi |
| 6,935,518 | B2 | 8/2005 | Winig et al. |
| 7,100,779 | B2 | 9/2006 | Berg |
| 7,424,958 | B1 | 9/2008 | Eley |
| 7,677,400 | B2 | 3/2010 | Bayazil et al. |
| 7,798,338 | B2 | 9/2010 | Maheu et al. |
| 8,123,185 | B2 | 2/2012 | Winig et al. |
| 8,136,677 | B2 | 3/2012 | Brozak et al. |
| D678,701 | S | 3/2013 | Hansen |
| 8,931,746 | B2 | 1/2015 | Fanning, Jr. et al. |
| 9,044,090 | B2 | 6/2015 | Drake et al. |
| 9,149,730 | B1 | 10/2015 | Hauser |
| 10,188,232 | B2 | 1/2019 | Lee et al. |
| D840,715 | S | 2/2019 | Löwenhielm |
| 10,405,675 | B1 | 9/2019 | Yu |
| D863,815 | S | 10/2019 | Löwenhielm |
| 2005/0072746 | A1 | 4/2005 | O'Brien |
| 2006/0278782 | A1 | 12/2006 | Lockwood et al. |
| 2008/0029471 | A1 | 2/2008 | Hurt |
| 2012/0233938 | A1 | 9/2012 | Siegel et al. |
| 2014/0149242 | A1 | 5/2014 | Turner, Jr. et al. |

FOREIGN PATENT DOCUMENTS

| | | | |
|---|---|---|---|
| GB | 465800 | A | 5/1937 |
| GB | 934767 | A | 8/1963 |
| JP | 2009-142639 | A | 7/2009 |
| KR | 10-2009-0099338 | A | 9/2009 |
| WO | WO 2003/055360 | A1 | 7/2003 |

OTHER PUBLICATIONS

English Translation of KR 10-2009-0099338 A (23 pages).

Written Opinion and Search Report from PCT Application No. PCT/US2020/053374 dated Jan. 15, 2021 (12 pages).

MULTIDIRECTIONAL WALL MOUNTED STORAGE PANEL

CROSS REFERENCE TO RELATED APPLICATIONS

This application is a continuation of U.S. application Ser. No. 16/587,904, filed Sep. 30, 2019 which is hereby incorporated by reference.

BACKGROUND

The present invention pertains to a modular display, storage and/or organization system for mounting objects on a vertical surface. A common example of these type of systems is a peg board and its associated mounting brackets. Peg boards are typically used for mounting objects such as tools or other items onto a wall in an organized manner. Brackets that fit into the holes or slots in the peg board and have forward facing hookMUs, clips or other supports are used to support the desired tools or accessories.

Many improvements have been attempted for the traditional peg board, but each offers its own advantages and disadvantages. One example, such as that used by the Wall Control® brand of peg boards, includes a peg board or storage panel having vertical slots as opposed to holes. This design constrains the peg board to being usable only in an orientation in which the slots extend vertically so that the slots can effectively retain the inserted brackets in the proper orientation. This is inconvenient when the desired support surface does not have space for the peg board in the required orientation, but may have space for the peg board in a different orientation. Furthermore, by providing only vertical slots the type of brackets which can be utilized is limited. Additionally, given that peg boards often come in a variety of colors and sizes, the fact that each peg board has only one usable orientation doubles the number of individual stock keeping units (SKUs) required in order to meet consumer demand. This increased both manufacturing as well as the level of inventory which is required to be maintained at both the retail and wholesale levels.

Thus, there is a need for improvement in this field.

SUMMARY

Certain embodiments include a storage panel for mounting items using a plurality of brackets. In one form, the storage panel includes a planar mounting surface having a longitudinal axis and a latitudinal axis and a means for securing the panel to a wall or other substantially vertical surface, such as support flanges that extend from the mounting surface. An array of spaced apart mounting slots extends through the mounting surface. The array of mounting slots includes longitudinal mounting slots and latitudinal mounting slots. The longitudinal mounting slots are each arranged to be parallel to said longitudinal axis and said latitudinal mounting slots are each arranged to be parallel to said latitudinal axis. One or more mounting openings may extend through the mounting surface.

A plurality of brackets each for insertion into one or more of the mounting slots may be removably attachable to the storage panel. Each bracket includes a bracket body having a hook or peg extending therefrom and an attachment mechanism including an upper tab and a lower tab extending from said bracket body in a direction opposite of said hook or peg. The upper tab and said lower tab are spaced apart so that the tabs are configured to fit within adjacent mounting slots on the mounting surface of the storage panel. The brackets may be more securely attached to the storage panel using an attachment mechanism that is inserted through the mounting opening through the mounting surface.

In some embodiments, the longitudinal mounting slots and said latitudinal mounting slots form a grid pattern. In one particular grid pattern, the longitudinal mounting slots may be substantially perpendicular to the latitudinal mounting slots. The distance between adjacent longitudinal mounting slots may be equal to the distance between adjacent latitudinal mounting slots. As an example, the distance between adjacent longitudinal mounting slots may be approximately ½ inch, ¾ inch or 1 inch and the distance between adjacent latitudinal mounting slots may also be approximately 1 or 2 inches. Additionally, the longitudinal mounting slots may be the same size as said latitudinal mounting slots. For example, each of the longitudinal and latitudinal mounting slots may be approximately ½ inch, ¾ inch or 1 inch in length.

In another form, a panel assembly includes a first panel and a second panel. The first panel includes a mounting surface and an array of spaced apart mounting slots extending through the mounting surface. The array includes a second column of mounting slots positioned near an edge of said first panel and a first column of mounting slots adjacent to said second column of mounting slots. The second panel includes a mounting surface and an array of mounting slots defined through the mounting surface. The array includes a third column of mounting slots positioned near an edge of the second panel and a fourth column of mounting slots adjacent to the third column of mounting slots. When the first panel is attached to the second panel, the distance between the second column of mounting slots and the third column of mounting slots is equal to the distance between the first column of mounting slots and the second column of mounting slots.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
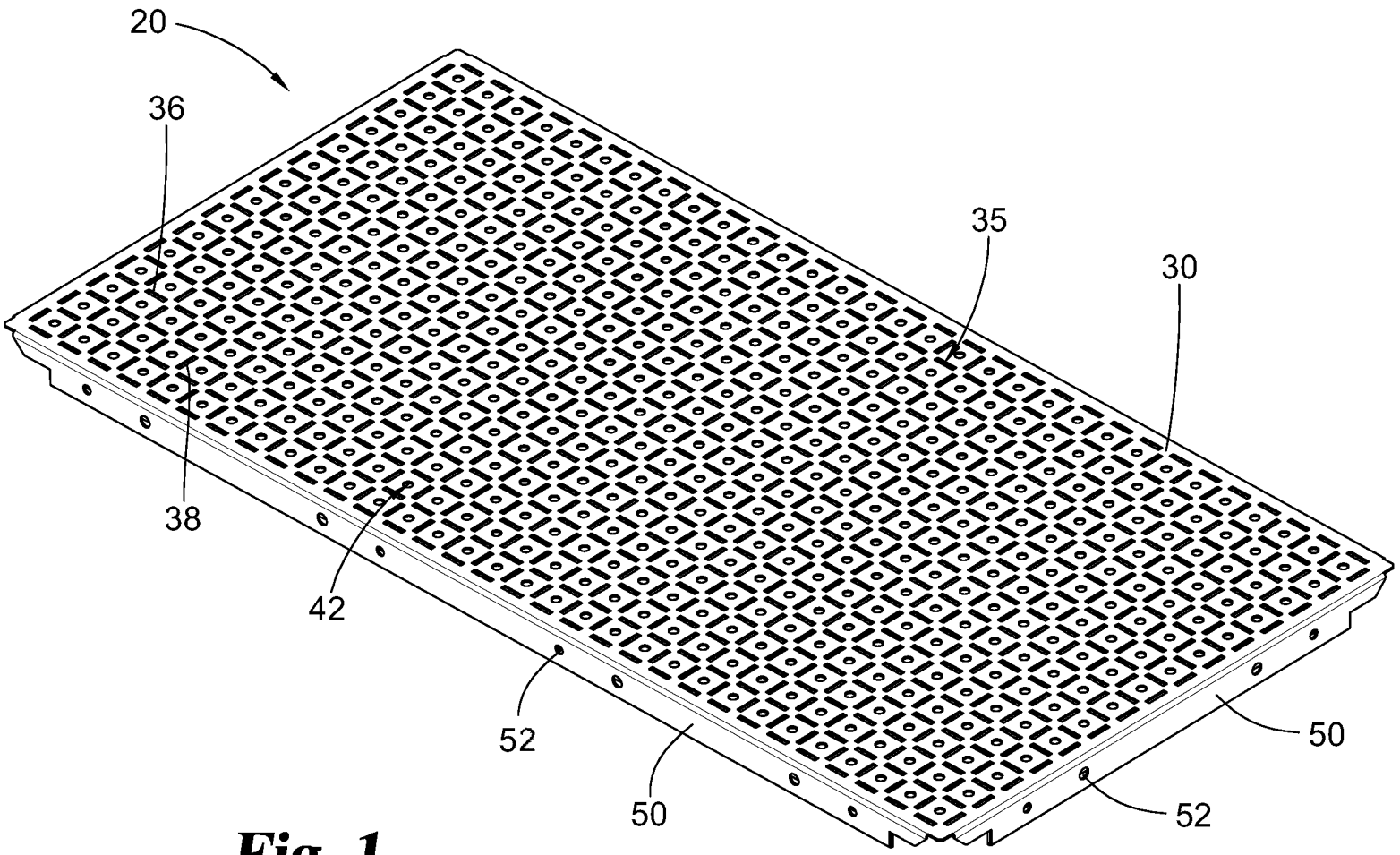
FIG. 1 is a perspective view of a multidirectional storage panel according to one form of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 is a perspective view of a modular wall storage panel or panel 20 for mounting on a wall or other suitable surface according to one form of the present invention. The panel 20 includes a planar mounting surface 30 and support flanges 50 which extend from the edges of mounting surface 30 at the periphery of panel 20. Support flanges 50 provide surfaces for securing the panel 20 to a wall using a top and/or bottom support bracket, cleat or other securement means, such as a conventional and suitably sized piece of lumber. However, a bracket is preferred so as to not block the clearance of any of the openings in the panel 20. Alternatively or additionally, screw holes or other attachment means may be provided on panel 20 for securing the panel 20 to the desired surface. Support flanges 50 may also be utilized to provide surfaces to attach to other panels like panel 20. Alternatively or additionally, the panel 20 may include apertures for direct securement to a wall, clear or bracket or some other know means for securing the panel 20 to a wall or other suitable surface.

The mounting surface 30 of panel 20 enables the intended storage and/or display function of panel 20, and enables users to customize the location of items to their preferences. Mounting surface 30 includes an array 35 of mounting slots (36 or 38). Mounting slots (36 or 38) may be engaged by the brackets described herein to provide support to hooks, shelves or other supports for articles or items which are to be stored or displayed on panel 20. Additionally, panel 20 may also include mounting openings 42 within the array 35 on mounting surface 30. These mounting opening 42 selectively enable further support and/or securement between a bracket and panel 20.

Figure 2:
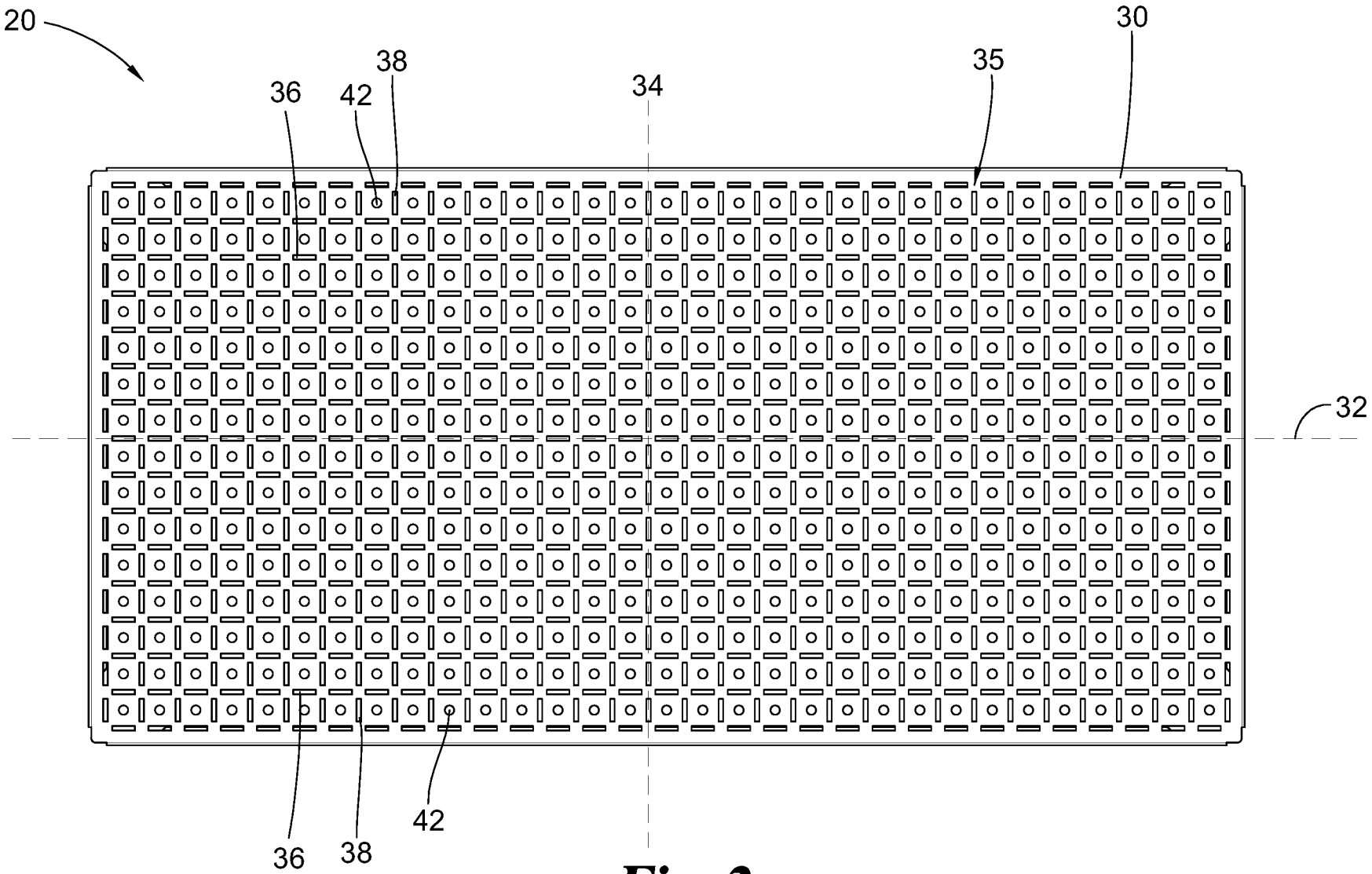
FIG. 2 is a front view of the multidirectional storage panel of FIG. 1.

A front view of the panel 20 in a horizontal configuration is shown in FIG. 2. As illustrated, panel 20 has a longitudinal axis 32 and a latitudinal axis 34 coplanar with the mounting surface 30, each of which are offset by 90 degrees from one another. In the embodiment shown, the length of the longitudinal axis 32 of the mounting surface 25 is greater than the latitudinal axis 34 of the mounting surface 30. It shall be appreciated that panel 20 may be created in a wide range of sizes, including lengths and widths as well as different arrays and spacing. For purposes of non-limiting example, a panel 20 may measure 1'×1', 2' by 4', 3'×6', 1'×3', 1'×4', 1'×6', 18"×36", 18"×2', 18"×3', 18"×4' or any other suitable size. In other embodiments, the length of the longitudinal axis 32 of mounting surface 25 may be equal to the width so that mounting surface 30 has a square shape. Additionally, depending upon the weight desired to be supported, panel 20 may be formed from 6, 10, 14 or 18 gauge steel or other materials having the necessary thickness.

The array 35 on mounting surface 30 includes a series of mounting slots and mounting openings. A set of longitudinal mounting slots 36 are defined through the mounting surface 30 and oriented so that each longitudinal mounting slot 36 is substantially parallel to the longitudinal axis 32 of the mounting surface 30. A set of latitudinal mounting slots 38 is also defined through the mounting surface 30 and oriented direction that is different from the orientation of the longitudinal mounting slots 36. The latitudinal mounting slots 38 are oriented so that each latitudinal mounting slot 38 is parallel to the latitudinal axis 34 of the mounting surface 30. The longitudinal mounting slots 36 are offset from the latitudinal mounting slots 38 by 90 degrees so that the longitudinal mounting slots 36 are substantially perpendicular to the latitudinal mounting slots 38. This arrangement of mounting slots creates a square shaped grid of mounting slots forming the array 35 on the mounting surface 30. The array 35 may be varied, such as the spacing between the mounting slots (36 or 38) and the size or shape of mounting openings 42 is greater or smaller. For purpose of non-limiting example, the mounting slots 36 may be spaced apart Mounting openings 42 are defined through mounting surface 30 and positioned between the longitudinal mounting slots 36 and the latitudinal mounting slots 38. As shown in FIG. 2, a single mounting opening 42 is surrounded by four mounting slots, two longitudinal mounting slots 36 and two latitudinal mounting slots 38. In some embodiments, a mounting opening 42 may be defined through mounting surface 30 in every square shaped portion formed by the mounting slots. In other embodiments, mounting openings 42 may be defined through mounting surface 30 in only selected square shaped portion formed by the mounting slots rather than all of the square shaped portions. The mounting opening 42 provides an additional anchoring point for a bracket that is attached to the panel 20.

In addition to the size of panel 20, the array 35 may also be varied, such as the spacing between the longitudinal mounting slots 36 and the latitudinal mounting slots 38 as well as the size or shape of mounting openings 42. For purpose of non-limiting example, each row of longitudinal mounting slots 36 may be spaced apart by ½", 1", 1.5", 2" or some other distance. Similarly, each column of latitudinal mounting slots 38 may be spaced apart by ½", 1", 1.5", 2" or some other distance. Preferably, the spacing of the longitudinal and latitudinal mounting slots 36 and 38 is the same so that the panel 20 may be utilized in either orientation without disruption to the brackets designed for use therewith. Additionally, the size and frequency of mounting openings 42 may also be varied.

Additionally, as shown in FIG. 2, the longitudinal mounting slots 36 extend along substantially the entire length of the longitudinal axis 32 and the latitudinal mounting slots 38 extend along substantially the entire length of the latitudinal axis 34. However, in different embodiments array 35 may be varied so that the longitudinal mounting slots 36 only extend along a portion of the length of the longitudinal axis 32 or the latitudinal mounting slots 38 only extend along a portion of the length of the latitudinal axis 34.

Figure 3:
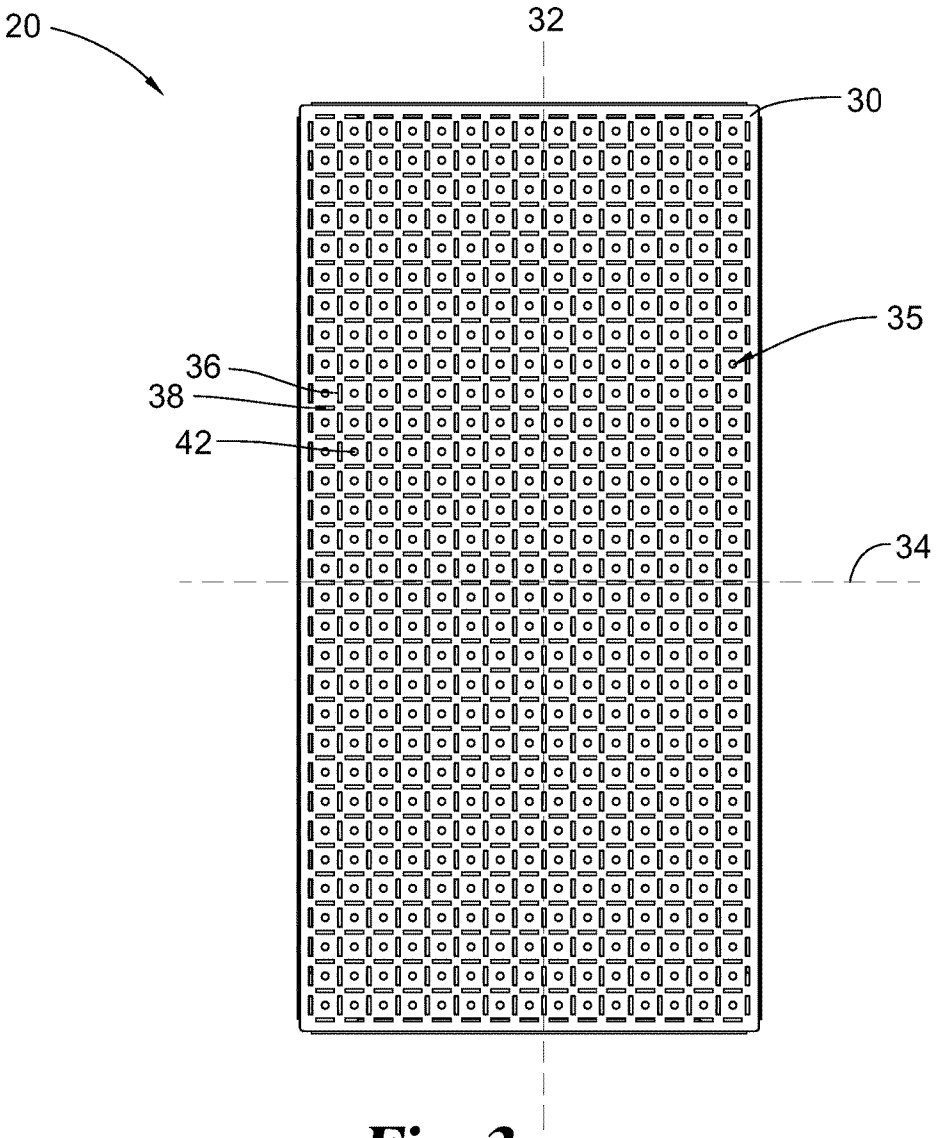
FIG. 3 is a front view of the multidirectional storage panel of FIG. 2 with the multidirectional storage panel being rotated by 90 degrees into a vertical orientation.

FIG. 3 illustrates the panel 20 shown in FIGS. 1 and 2 rotated by 90 degrees from its orientation shown in FIG. 2 into a vertical configuration. In this vertical configuration, the longitudinal axis 32 is oriented vertically and the latitudinal axis 34 is oriented horizontally. As shown, provided the spacing remains the same, the array 35 of mounting slots 36 or 38 on mounting surface 30 maintains the same general arrangement as shown in FIG. 2. In this orientation, the longitudinal mounting slots 36 are arranged vertically while the latitudinal mounting slots 38 are arranged horizontally. The symmetrical nature of the array 35 of mounting slots regardless of whether panel 20 is oriented horizontally or vertically allows panel 20 to be attached to a wall or any other desired support surface in either the orientation shown in FIG. 2 or FIG. 3 and maintain the same general array 35 of mounting slots. This allows panel 20 to be oriented as necessary to fit on different areas of a wall or support surface.

For cosmetic as well as longevity purposes, panel 20 may be made from metal or some other rigid and durable material. Panel 20 may also be painted, powder coated or the like in one of a variety of colors to provide for the desired aesthetic appearance.

Figure 4A:
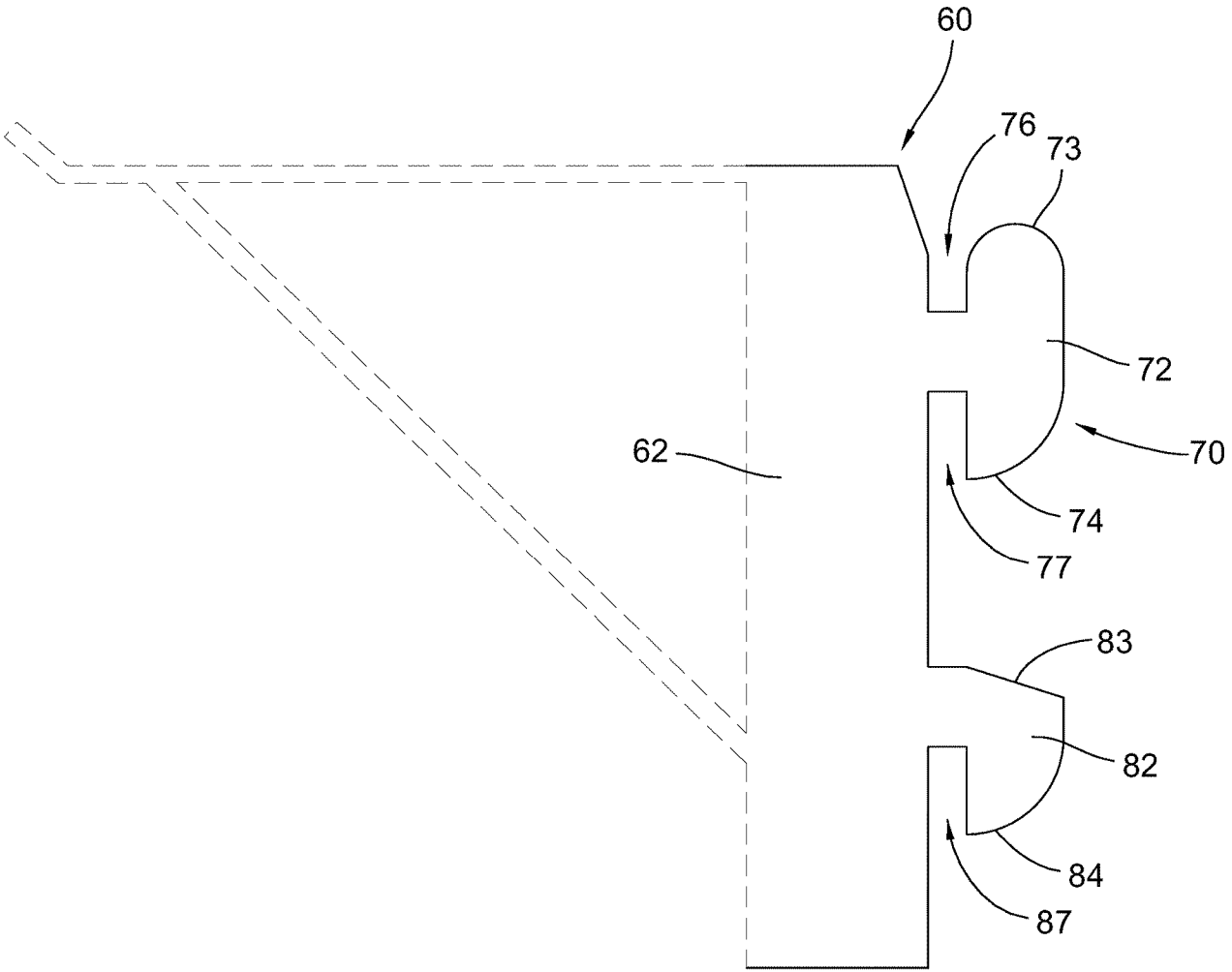
FIG. 4A is a side view of an attachment mechanism for a bracket that is attachable to the multidirectional storage panel of FIG. 1.

FIG. 4A shows an attachment mechanism 70 for a representative bracket 60 for use with panel 20. Bracket 60 includes a bracket body 62 which supports a standard mounting hook extending opposite the attachment mechanism 70, but it shall be appreciated that the attachment mechanism 70 is compatible with panel 20 is universally applicable to many different peg board type supports. Attachment mechanism 70 is configured to make bracket 60 be releasably attachable to panel 20. The attachment mechanism 70 includes an upper tab 72 that has a rounded top edge 73 and a partially rounded bottom edge 74 and is sized so that upper tab 72 may fit within a single longitudinal mounting slot 36 or a single latitudinal mounting slot 38. A first upper tab slot 76 is defined between the rounded top edge 73 and the bracket body 62. A second upper tab slot 77 is defined between bottom edge 74 and the bracket body 62. Lower tab 82 has an angled top edge 83 and a partially rounded bottom edge 84 and is sized so that lower tab 82 can fit within a single longitudinal mounting slot 36 or a single latitudinal mounting slot 38. A lower tab slot 87 is defined between bottom edge 84 and the bracket body 62.

Figure 4B:
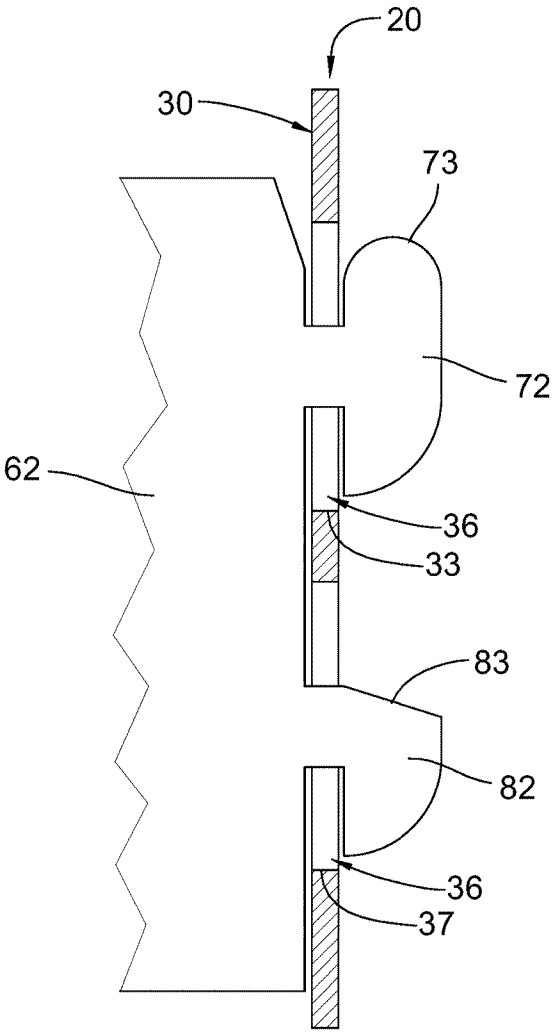
FIG. 4B is a side view of the attachment mechanism of FIG. 4A inserted through the mounting slots of a mounting surface of the multidirectional storage panel of FIG. 1.

FIG. 4B shows attachment mechanism 70 inserted into panel 20 from a side view. Upper tab 72 is spaced from lower tab 82 so that when upper tab 72 is fit into a longitudinal mounting slot 36, lower tab 82 can be fit into an adjacent longitudinal mounting slot 36. It shall be appreciated that more or fewer tabs may be included within bracket 60. Similarly, if upper tab 72 is inserted into a latitudinal mounting slot 38, lower tab 82 is able to be inserted into an adjacent latitudinal mounting slot 38. When upper tab 72 is inserted into a mounting slot 36 or 38 and then released, gravity acts on upper tab 72 so that the lower edge 33 of the mounting surface 30 that defines the mounting slot 36 or 38 is inserted into second upper tab slot 77. When located in the second upper tab slot 77, the edge 33 of the mounting surface 30 is constrained by bracket body 62 and the rounded bottom edge 74 of the upper tab 72 to prevent bracket 60 from being removed laterally from mounting slot 36 or 38.

The lower tab 82 works similarly to keep bracket 60 attached to the panel 20. When lower tab 82 is inserted into a mounting slot 36 or 38 and then released, gravity acts on lower tab 82 so that the edge 37 of the mounting surface 30 that defines the mounting slot 36 or 38 is inserted into lower tab slot 87. When located in the lower tab slot 87, the lower edge 37 of the mounting surface 30 is constrained by bracket body 62 and the rounded bottom edge 84 of the lower tab 82 to prevent bracket 60 from being removed laterally from mounting slot 36 or 38.

Because attachment mechanism 70 relies on gravity to keep bracket 60 attached to the mounting surface 30, the tabs 72, 82 of attachment mechanism 70 are typically inserted into latitudinal mounting slots 38 when the panel 20 is oriented horizontally as shown in FIG. 2. However, other uses may be made of the horizontally oriented slots. When the panel 20 is oriented vertically, as shown in FIG. 3, the tabs 72, 82 of attachment mechanism 70 are inserted into longitudinal mounting slots 36 to removably attach bracket 60 to panel 20. However, the symmetrical nature of the array 35 of mounting slots 36, 38 allows panel 20 to be arranged in either orientation and still be capable of holding bracket 60. Attachment mechanism 70 and or bracket 60 may also be made from metal or some other rigid and durable material and may also be painted, powder coated or the like in one of a variety of colors to provide for the desired aesthetic appearance.

In an alternative embodiment of bracket 60 (not shown), upper tab 72 and lower tab 82 may be rotated by 90 degrees with respect to bracket body 63 so as to secure into the latitudinal mounting slots 38 when the panel 20 is oriented vertically, as shown in FIG. 3. Since gravity does not secure the bracket 60 within the mounting slots 38 a fastener may be used to secure the bracket 60 to a corresponding mounting opening 42, such as by using a bracket opening in bracket 60 similar to that shown in as bracket opening 165 in FIG. 5A. It shall be appreciated that more or fewer tabs may be included within bracket 60.

Figure 5A:
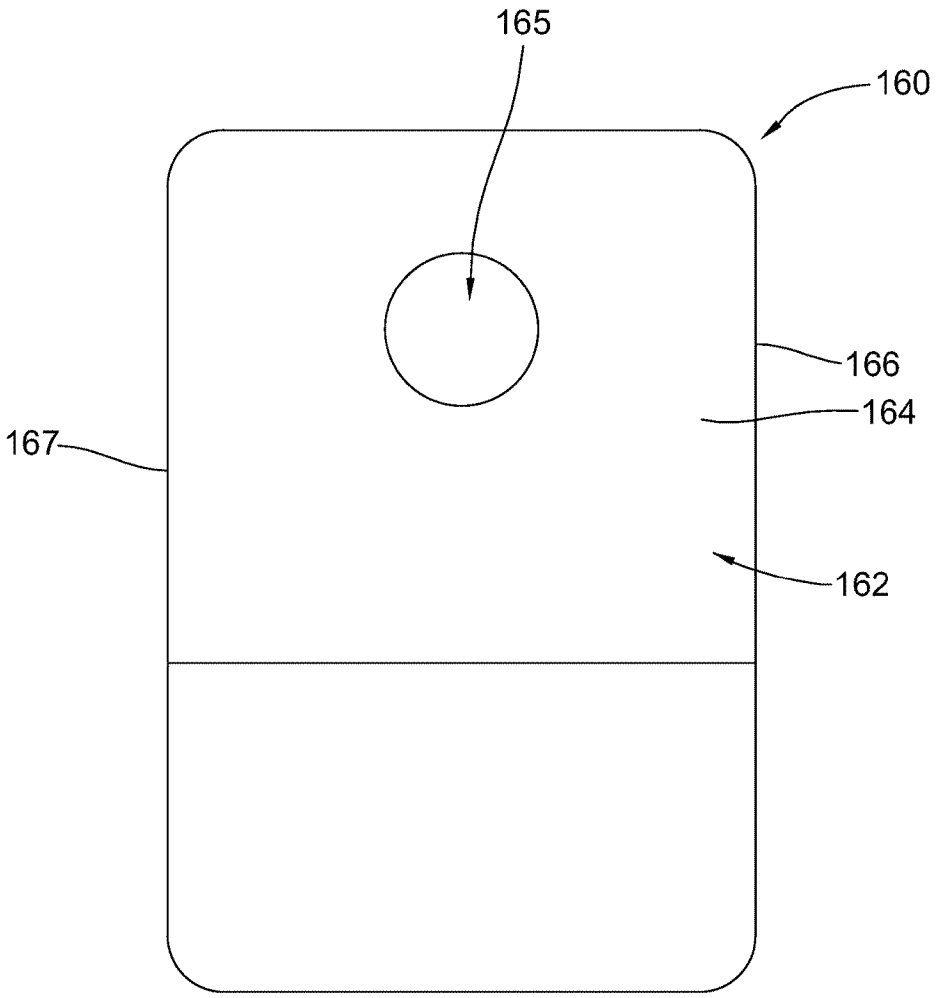
FIG. 5A is a front view of an embodiment of a bracket attachable to the multidirectional storage panel of FIG. 1.
Figure 5B:
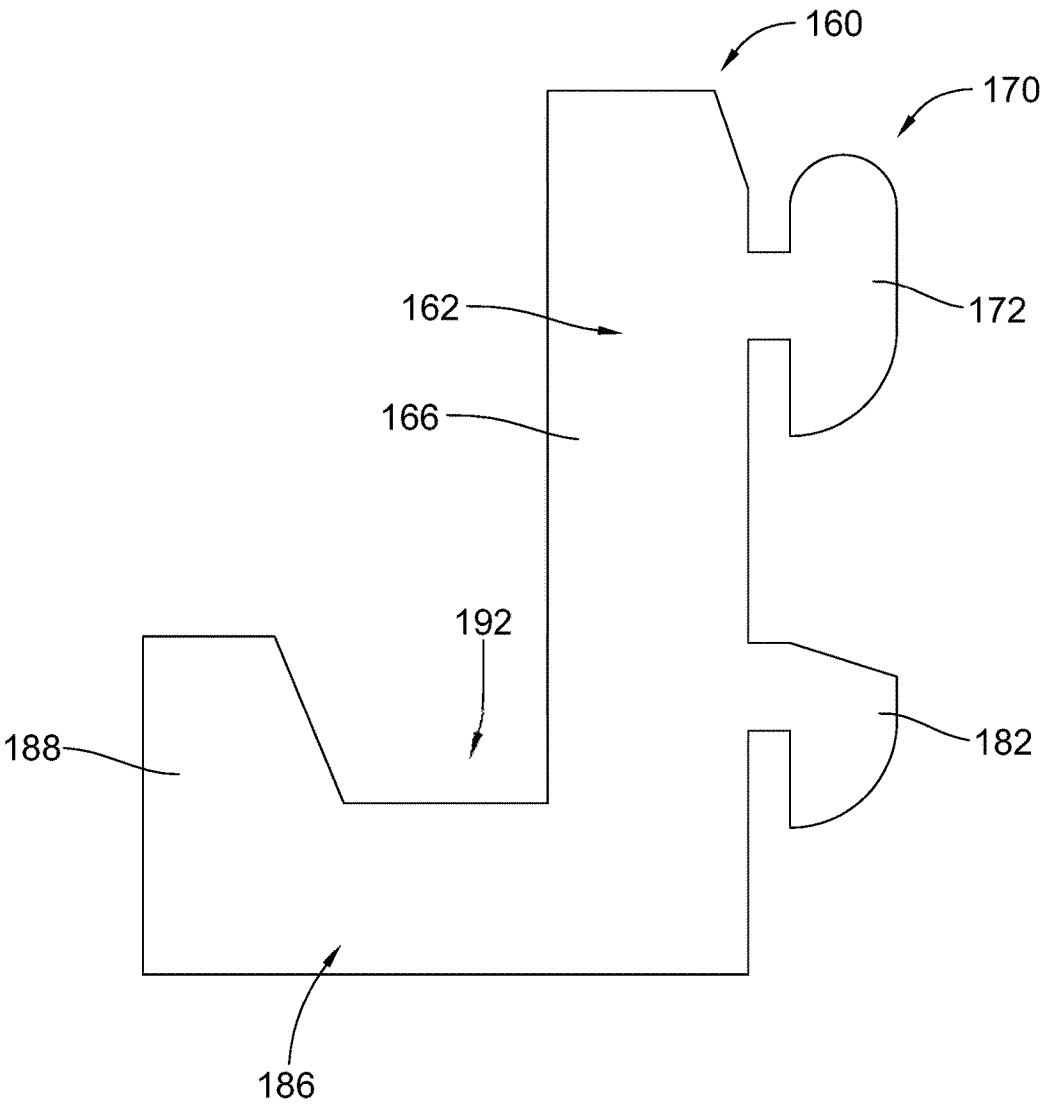
FIG. 5B is a side view of the bracket of FIG. 5A.

FIGS. 5A and 5B illustrate an embodiment of a bracket 160, with FIG. 5A showing a front view and FIG. 5B a right side view. Bracket 160 includes a bracket body 162 that has a front face 164 and two side edges 166, 167 that each extend rearwardly from a respective side of front face 164. Side edge 166 includes an attachment mechanism 170 with an upper tab 172 and a lower tab 182 that extends rearwardly from the side edge 166. Similarly, side edge 167 includes a corresponding attachment mechanism 170 (not shown) that extends rearwardly from side edge 167. A bracket opening 165 is defined through the front face 164 of bracket body 162. The bracket opening 165 is sized and positioned relative to attachment mechanism 170 so as to correspond with the mounting openings 42 that are defined through mounting surface 30 when bracket 160 is properly mounted onto mounting surface 30. Fasteners such as a push pin clip, rivet clip, a screw, a nut and bolt arrangement or some other mechanism may be inserted through bracket opening 165 and into mounting opening 42 to assist in securing bracket 160 to panel 20. Preferably, this mechanism is selectively removable so that the layout of brackets on the panel 20 may be reconfigured as desired.

Bracket 160 also includes an arm 186 that extends from the front face 164 of the bracket body 162. In the illustrated embodiment, arm 186 includes a hook portion 188 that protrudes from arm 186 to define a gap 192 between front face 164 and hook portion 188. Objects may be held by bracket 60 by placing the object into gap 192 to be supported by arm 186 or items may be hung on arm 186. Bracket 160 is attached to panel 20 by inserting the tabs 172, 182 of the attachment mechanism 70 extending from side edge 166 into corresponding longitudinal mounting slots 36 or latitudinal mounting slots 38, depending on the orientation of the panel 20. Then, the tabs 172, 182 of the attachment mechanism 70 extending from side edge 167 are inserted into corresponding longitudinal mounting slots 36 or latitudinal mounting slots 38 in a column that is adjacent to the mounting slots 36 or 38 into which the tabs 172, 182 of the attachment mechanism 70 extending from side edge 166 were inserted. A securement may be inserted through bracket opening 165 and mounting opening 42 to lock bracket 160 into place and to prevent it from moving, such as when a tool is removed from it.

Figure 6:
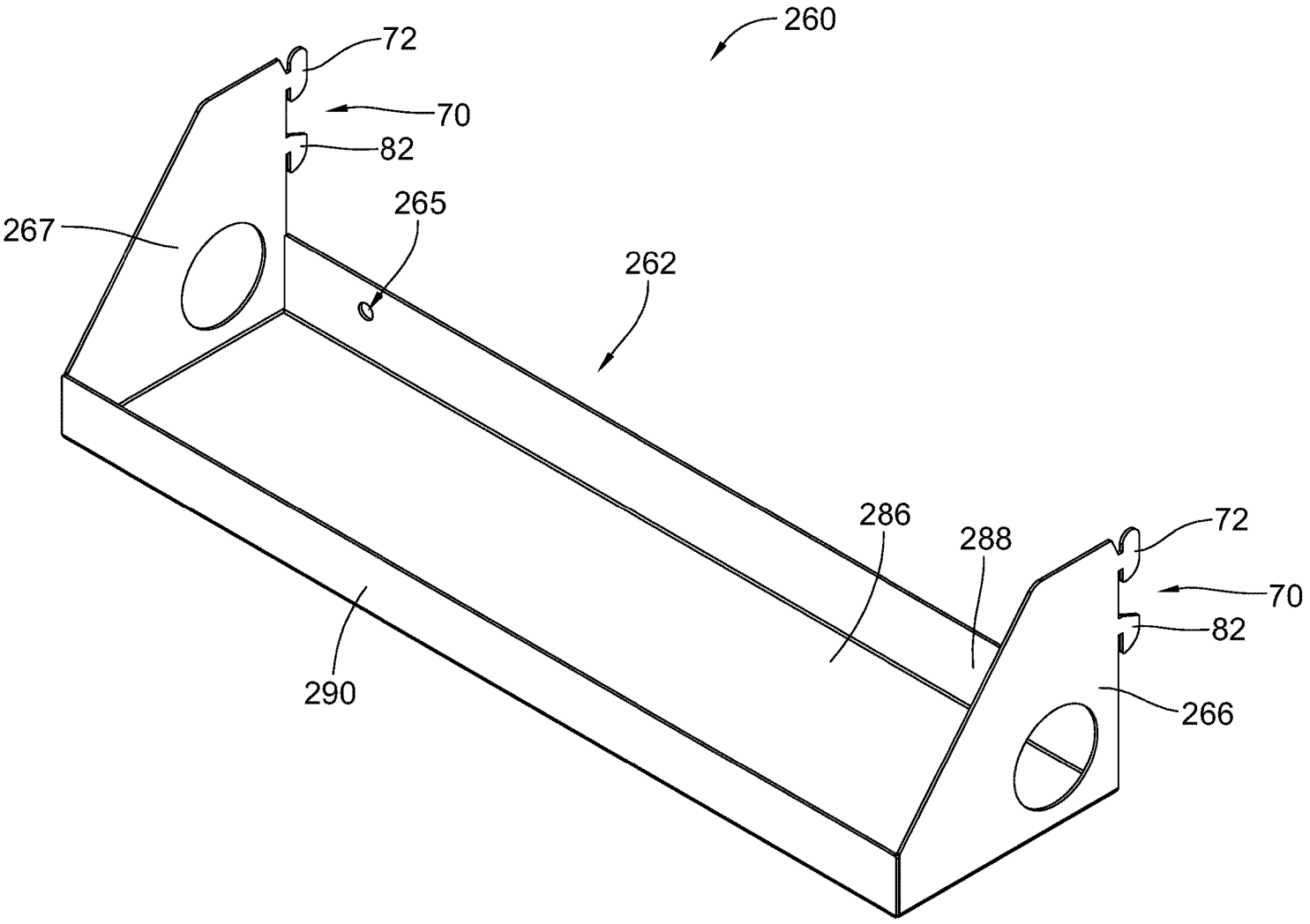
FIG. 6 is a front view of an embodiment a bracket attachable to the multidirectional storage panel of FIG. 1.

An alternative embodiment of a bracket or support suitable for mounting to panel 20 is shown in FIG. 6. Bracket 260 includes a bracket body 262 that has a bracket base 286 and a pair of bracket flanges 288, 290 extending from bracket base 286 to form a basket or shelf-like structure. A mounting opening 265 is defined through bracket flange 288 and arranged to correspond to a mounting opening 42 defined through mounting surface 30. Additional mounting openings 265 may be provided, so long as the spacing of array 35 is provided for. A fastener may be inserted through mounting opening 265 and into mounting opening 42 to assist in securing bracket 260 to panel 20.

A side edge 266 extends from one end of bracket body 262 and a corresponding side edge 267 extends from the opposite end of bracket body 262. Each side edge 266, 267 includes the attachment mechanism 70 described in FIG. 4 for removably attaching bracket 260 to the mounting surface 30 of a panel 20. The length of bracket 260 may be varied to accommodate different sized tools or objects. However, the distance between side edge 266 and side edge 267 should correspond to some multiple of the discrete distance between the longitudinal mounting slots 36 or the latitudinal mountings slots 38. Therefore, when the tabs 72, 82 of the attachment mechanism 70 extending from side edge 266 are inserted into a respective mounting slot 36 or 38, the tabs 72, 82 of the attachment mechanism 70 extending from side edge 267 can also be inserted into a respective mounting slot 36 or 38.

Any additional desired shape for a bracket 60 for holding different tools or objects on panel 20 are contemplated as long as the bracket 60 includes at least one attachment mechanism 70 or includes an opening for attachment to a mounting opening 42. As several non-limiting examples, other embodiments of a bracket 60 may include hooks, shelves, pegs, slots, grooves, cupholders, towel racks, paper towel holders, power strips, drill cups, phone or tablet holders or any combination of these or any other desired features. It shall be appreciated that a bracket 60 may include a single attachment mechanism 70 or may include two or more attachment mechanisms 70 to be attached to panel 20.

Figure 7:
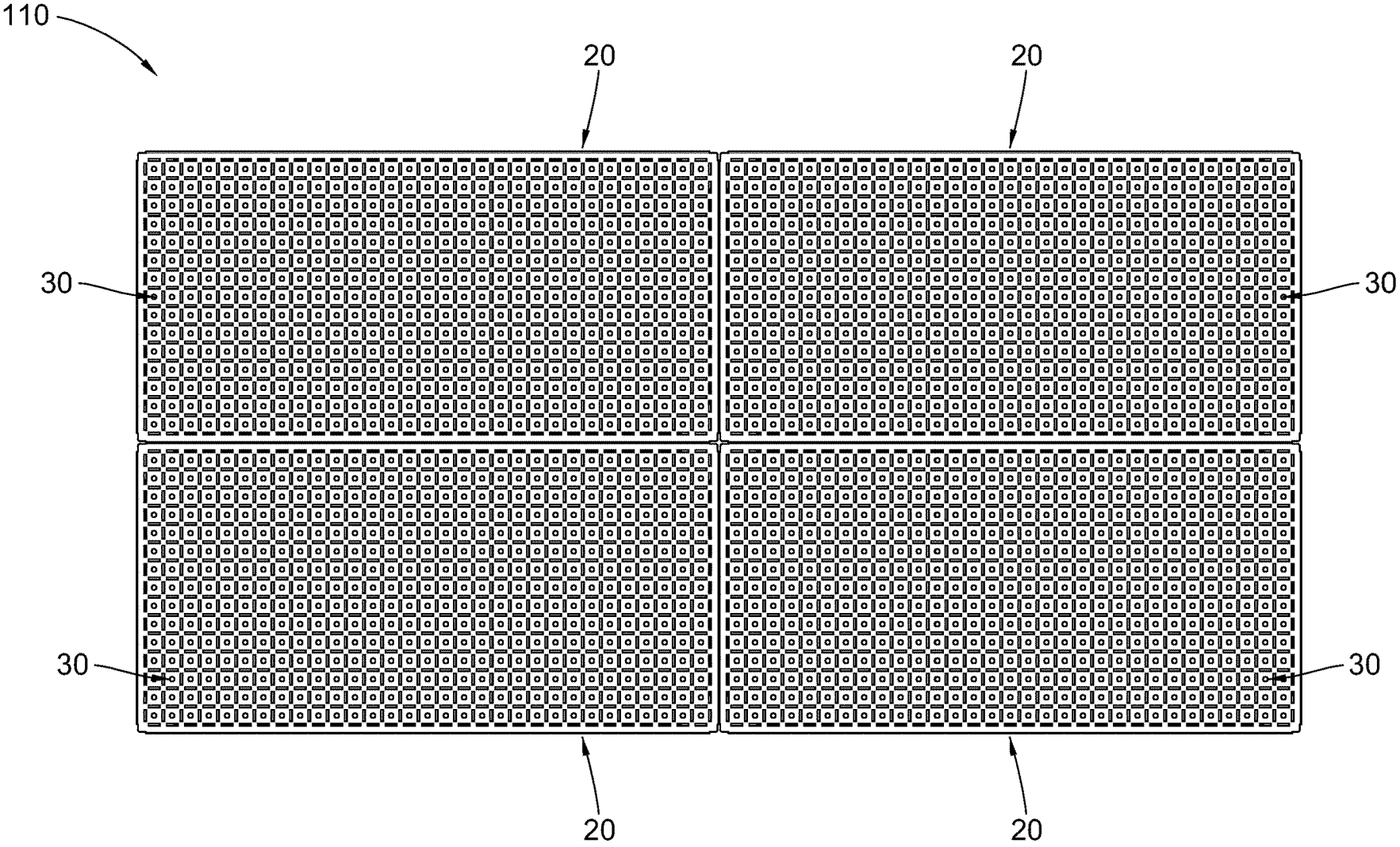
FIG. 7 is a front view of a wall mounting assembly including more than one of the multidirectional storage panels shown in FIG. 1 arranged adjacent to each other to form a larger mounting surface.

FIG. 7 shows a panel assembly 110 that includes multiple panels 20 to form a mounting surface with greater surface area and strength than can be provided by a single panel 20. The panels 20 may be connected by aligning the mounting openings 52 on the support flanges 50 of adjacent panels 20 and inserting a fastener through the aligned mounting openings 52. Any fastener suitable for attaching the panels 20 may be used. In other embodiments, the panels 20 may be attached to a wall or a support surface so that the panels 20 are arranged adjacent to each other without connection through the mounting openings 52 in support flanges 50.

The panels 20 shown in FIG. 7 are arranged so that the longitudinal axes 32 are oriented horizontally, but in other embodiments, the panels 20 may rotated 90 degrees so the longitudinal axes 32 are oriented vertically. Any other desired arrangement or number of panels 20 may be used when combining more than one panel 20 to increase the surface area of the mounting surface. As an example, in other embodiments, one panel 20 may be arranged so its longitudinal axis 32 is oriented horizontally and an adjacent panel 20 may be arranged so that its longitudinal axis 32 is oriented vertically.

Figure 8:
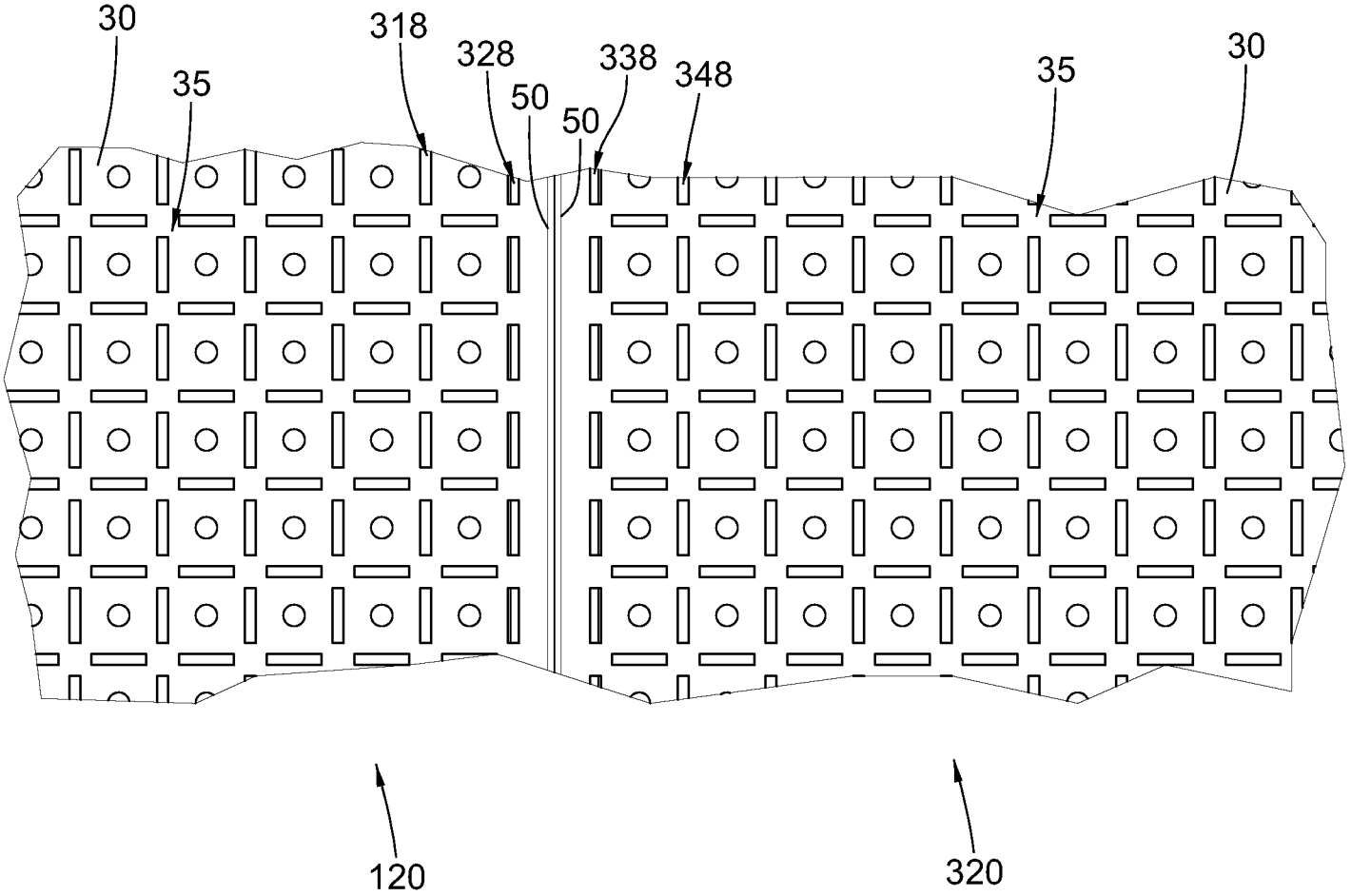
FIG. 8 is a zoomed view of a seam between two adjacent multidirectional storage panels shown in FIG. 7.

A close-up view of a panel assembly including adjacent panels 120 and 320 of FIG. 7 is illustrated in FIG. 8. Panels 120 and 320 each include an array 35 of mounting slots defined through mounting surface 30. The first panel 120 includes a first column of latitudinal mounting slots 318 spaced from a second column of latitudinal mounting slots 328. Likewise, the second panel 320 includes a third column of latitudinal mounting slots 338 spaced from a fourth column of latitudinal mounting slots 348.

When the support flanges 50 of adjacent panel 120 and 320 are in contact with each other or attached to each other, the distance between the second column of latitudinal mounting slots 328 and the third column of latitudinal mounting slots 338 is equal to the distance between the first column of latitudinal mounting slots 318 and the second column of latitudinal mounting slots 328. This distance is also equal to the distance between the third column of latitudinal mounting slots 338 and the fourth column of latitudinal mounting slots 348. Maintaining this equal distance even between columns of latitudinal mounting slots 328 and 338 on adjacent panels 120 and 320 allows a bracket to span the seam between adjacent panels 120 and 320 and attach using the latitudinal mounting slots 328 and 338.

Although panel 20 is shown to have a rectangular shape, in other embodiments, panel 20 may have any other desired shape. The array 35 may still have the same grid-like arrangement of mounting slots 36 and 38 on different shaped panels 20, allowing removable attachment of a bracket 60.

Figure 9:
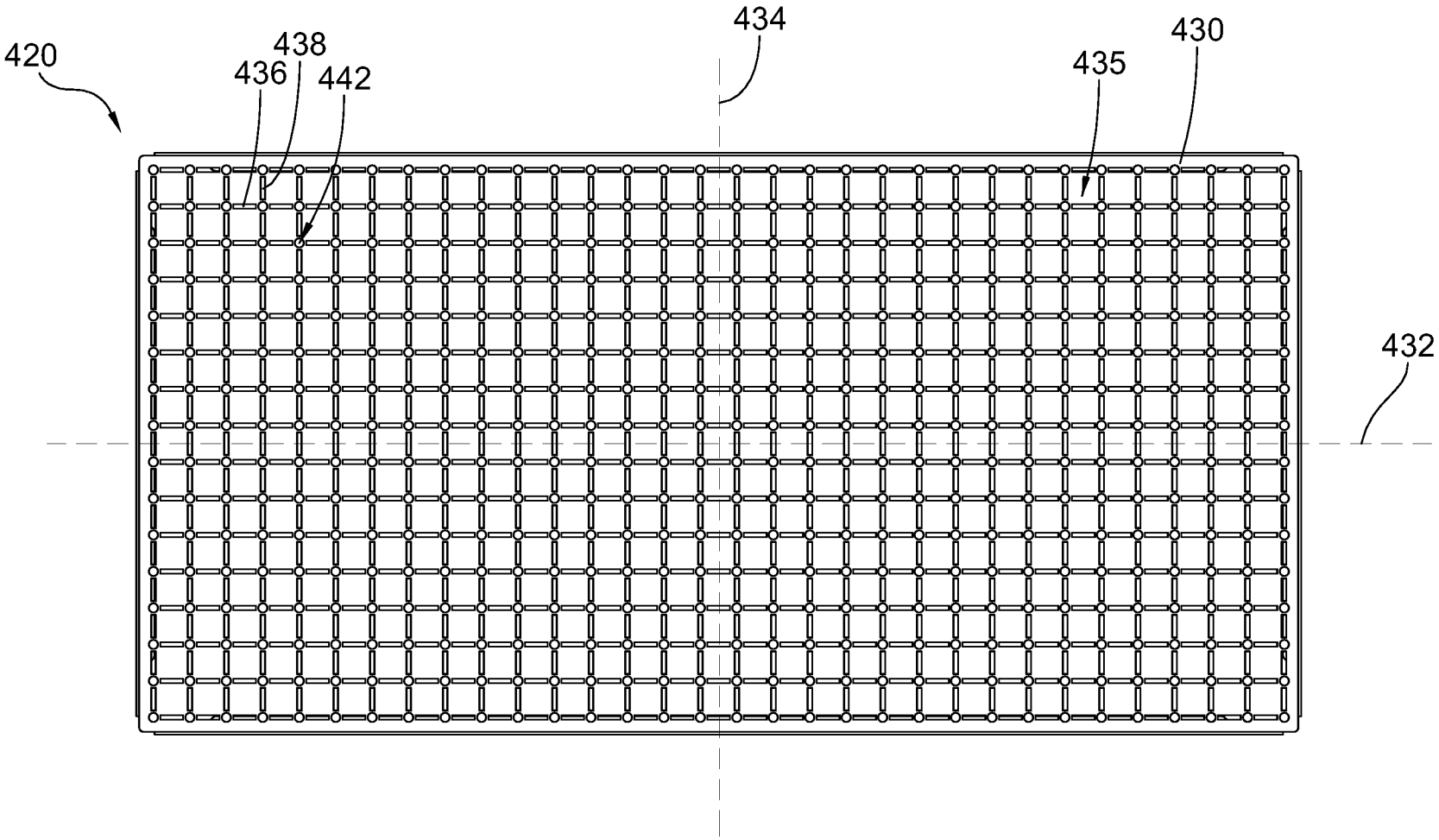
FIG. 9 is front view of a multidirectional storage panel according to an alternate form of the present invention, including an alternate layout of the array of slots.

FIG. 9 is a front view of another embodiment of a modular wall storage panel 420 for mounting on a wall. The panel 420 includes a mounting surface 430. The mounting surface 430 includes an array 435 of mounting slots and mounting openings that may be engaged by brackets to provide support to articles or items that are stored on panel 420. Except as described, panel 420 is the same as panel 20 of FIG. 1.

The array 435 on mounting surface 430 includes a series of mounting slots and mounting openings. A set of longitudinal mounting slots 436 are defined through the mounting surface 430 and oriented so that each longitudinal mounting slot 436 is substantially parallel to the longitudinal axis 432 of the mounting surface 430. A set of latitudinal mounting slots 438 is also defined through the mounting surface 430 and oriented direction that is different from the orientation of the longitudinal mounting slots 436. The latitudinal mounting slots 38 are oriented so that each latitudinal mounting slot 438 is parallel to the latitudinal axis 434 of the mounting surface 430. The longitudinal mounting slots 436 are offset from the latitudinal mounting slots 438 by 90 degrees so that the longitudinal mounting slots 436 are substantially perpendicular to the latitudinal mounting slots 438. This arrangement of mounting slots shown in this embodiment creates a square shaped grid of mounting slots forming the array 435 on the mounting surface 430.

Mounting openings 442 are defined through mounting surface 430 and positioned at what would be the intersection of longitudinal mounting slots 436 and the latitudinal mounting slots 438 as opposed to at the center of the squares they form as shown in FIG. 1. In other embodiments, mounting openings 442 may be defined through mounting surface 430 in only selected square shaped portion formed by the mounting slots rather than all of the square shaped portions. The mounting opening 442 provides an additional anchoring point for a bracket that is attached to the panel 420.

Figure 10:
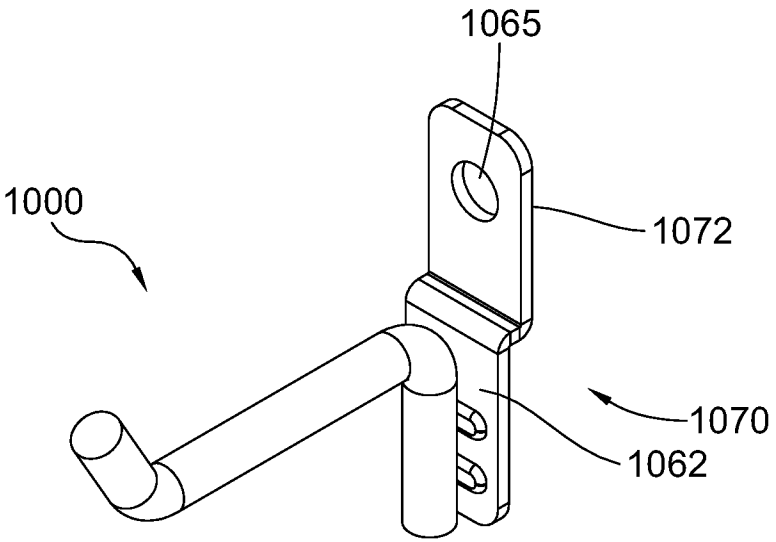
FIG. 10 is a perspective view of a second type of bracket suitable for attachment to the multidirectional storage panel of FIG. 1 or FIG. 9.

FIG. 10 is a perspective view of a first type of bracket 1000 suitable for attachment to the storage panel 20 of FIG. 1 or 420 of FIG. 9. For ease of description, only storage panel 20 and its components will be described with respect to bracket 1000 and each of the bracket types described in FIGS. 11 and 12 below. Bracket 1000 is illustrated in the form of traditional peg board support, such as straight hook or a "J" hook. Bracket 1000 includes an attachment mechanism 1070 comprising a bracket body 1062 for mounting against the face of mounting surface 30 and a tab 1072 that is offset rearward from the bracket body 1062. As illustrated, the tab 1072 is sized to fit within a single longitudinal mounting slot 36 or a single latitudinal mounting slot 38 of panel 20. As opposed to a vertically oriented slot, bracket 1000 is configured to secure into a horizontally oriented slot, such as longitudinal mounting slot 36 of panel 20 when it is in the orientation shown in in FIG. 2 or the latitudinal mounting slots 38 of panel 20 when it is in the alternate orientation shown in FIG. 3.

Bracket 1000 also may include one or more bracket openings 1065, which are defined through bracket body 1062. Each bracket opening 1065 is sized and positioned relative to attachment mechanism 1070 and tab 1072 so as to correspond with the mounting openings 42 that are defined through mounting surface 30 when bracket 1000 is properly mounted into mounting surface 30. As is described above, fasteners such as a push pin clip, rivet clip, a screw, a nut and bolt arrangement or some other mechanism may be inserted through bracket opening 1065 and into mounting opening 42 to assist in securing bracket 1000 to panel 20.

Figure 11:
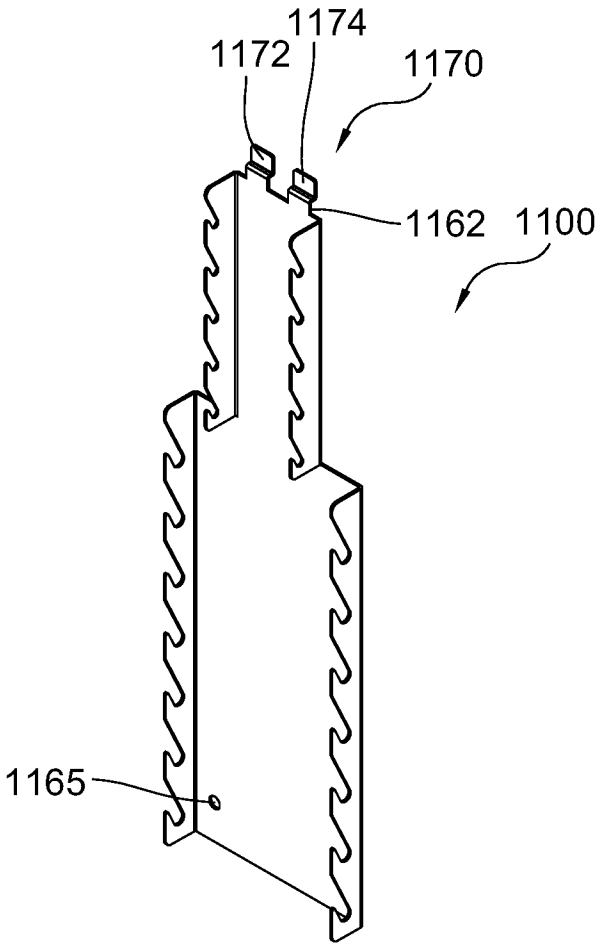
FIG. 11 is a perspective view of one type of bracket suitable for attachment to the multidirectional storage panel of FIG. 1 or FIG. 9.

FIG. 11 is a perspective view of a second type of bracket 1100 suitable for attachment to the storage panel 20 of FIG. 1 or 420 of FIG. 9. Bracket 1100 includes an attachment mechanism 1170 comprising two tabs 1172 and 1174 that are each offset rearward from the bracket body 1162, which is for mounting against the face of mounting surface 30. The tabs 1172 and 1174 are sized and spaced apart so as to fit within two adjacent mounting slots 36 of panel 20. As opposed to a vertically oriented slot, bracket 1100 is configured to secure into horizontally oriented slots, such as longitudinal mounting slots 36 of panel 20 when it is in the orientation shown in in FIG. 2 or the latitudinal mounting slots 38 of panel 20 when it is in the alternate orientation shown in FIG. 3. Alternatively, the tabs 1172 and 1174 could be spaced apart further so as to fit in two non-adjacent longitudinal mounting slots (36 or 38), depending upon the size of bracket 1100 and the load to be supported.

Bracket 1100 also may include one or more bracket openings 1165, which are defined through bracket body 1162. Each bracket opening 1165 is sized and positioned relative to attachment mechanism 1170 so as to correspond with the mounting openings 42 that are defined through mounting surface 30 when bracket 1100 is properly mounted onto mounting surface 30. As is described above, fasteners such as a push pin clip, rivet clip, a screw, a nut and bolt arrangement or some other mechanism may be inserted through bracket opening 1165 and into mounting opening 42 to assist in securing bracket 1100 to panel 20.

Figure 12:
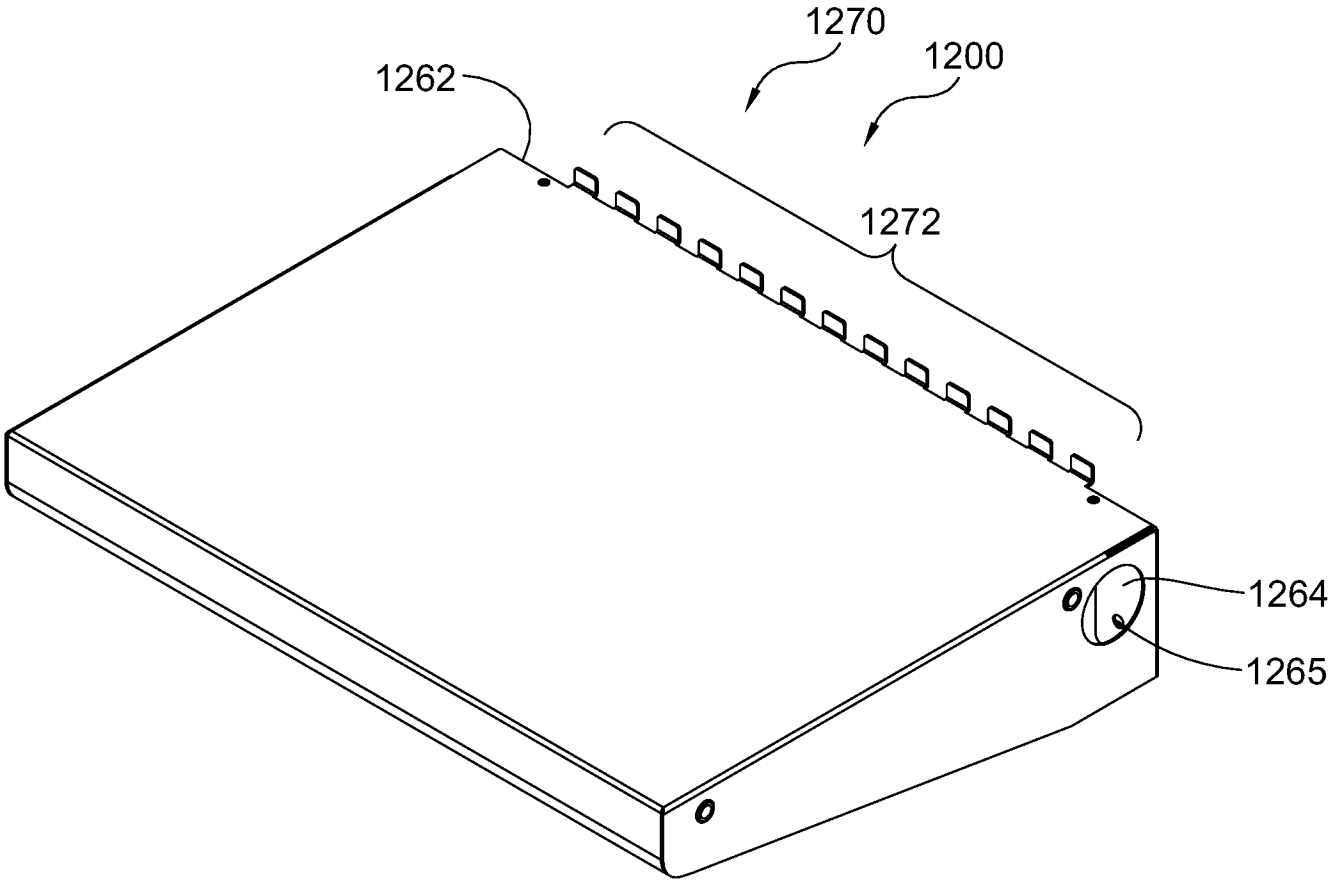
FIG. 12 is a perspective view of a shelf suitable for attachment to the multidirectional storage panel of FIG. 1 or FIG. 9.

FIG. 12 is a perspective view of a shelf bracket 1200 suitable for attachment to the storage panel 20 of FIG. 1 or 420 of FIG. 9. Bracket 1200 is in the form of a shelf or other horizontal support. Bracket 1200 includes an attachment mechanism 1270 comprising a plurality of tabs 1272 that are each offset rearward from the bracket body 1262. The tabs 1272 are sized and spaced apart so as to fit within a plurality of adjacent mounting slots 36 or 38 of panel 20. As opposed to a vertically oriented slot, bracket 1200 is configured to secure into horizontally oriented slots, such as longitudinal mounting slots 36 of panel 20 when it is in the orientation shown in in FIG. 2 or the latitudinal mounting slots 38 of panel 20 when it is in the alternate orientation shown in FIG. 3. Alternatively, the tabs 1272 could be spaced apart further so as to fit in non-adjacent longitudinal mounting slots 36 or 38, every other mounting slot 36 or 38, or the like, depending upon the size of bracket 1200.

Bracket 1200 also may include one or more bracket openings 1265, which are defined through the front face 1264 of bracket body 1262. The bracket opening 1265 is sized and positioned relative to attachment mechanism 1270 so as to correspond with the mounting openings 42 that are defined through mounting surface 30 when bracket 1200 is properly mounted onto mounting surface 30. As is described above, fasteners such as a push pin clip, rivet clip, a screw, a nut and bolt arrangement or some other mechanism may be inserted through bracket opening 1265 and into mounting opening 42 to assist in securing bracket 1200 to panel 20.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A storage panel for mounting items using a plurality of brackets comprising:

a planar mounting surface having a longitudinal axis and a latitudinal axis;

a means for securing the panel to a wall or other substantially vertical surface; and an array of spaced apart mounting slots extending through said mounting surface, wherein said array of mounting slots includes longitudinal mounting slots and latitudinal mounting slots;

wherein said longitudinal mounting slots are each arranged to be parallel to said longitudinal axis and said latitudinal mounting slots are each arranged to be parallel to said latitudinal axis;

a plurality of mounting openings extending through said mounting surface, wherein said longitudinal mounting slots and said latitudinal mounting slots form a grid pattern and the plurality of mounting openings are located in the center of squares formed within the grid pattern;

at least one bracket having a bracket body, a bracket opening and an attachment mechanism for engaging with at least one of the mounting slots such that the bracket opening aligns with a mounting opening; and a means for securing the bracket to the planar mounting surface using the bracket opening and the mounting opening.

2. The storage panel of claim 1, wherein the spacing between the longitudinal mounting slots is fixed and equal to the spacing between the latitudinal mounting slots.

3. The storage panel of claim 1, wherein said longitudinal mounting slots are the same size as said latitudinal mounting slots.

4. The storage panel of claim 1, wherein said grid pattern spans the entire mounting surface.

5. The storage panel of claim 1, wherein said longitudinal mounting slots are perpendicular to said latitudinal mounting slots.

6. The storage panel of claim 1, wherein said longitudinal mounting slots extend across substantially the entire length of the longitudinal axis of said mounting surface, and wherein said latitudinal mounting slots extend across substantially the entire length of the latitudinal axis of said mounting surface.

7. The storage panel of claim 1, wherein said means for securing the panel includes one or more support flanges extending from said mounting surface.

8. The storage panel of claim 1, wherein a distance between adjacent longitudinal mounting slots is 1 inch, and wherein a distance between adjacent latitudinal mounting slots is 1 inch.

9. A storage panel for mounting items using a plurality of brackets comprising:

a planar mounting surface having a longitudinal axis and a latitudinal axis;

a means for securing the panel to a wall or other substantially vertical surface;

an array of spaced apart mounting slots extending through said mounting surface, wherein said array of mounting slots includes longitudinal mounting slots and latitudinal mounting slots;

wherein said longitudinal mounting slots are each arranged to be parallel to said longitudinal axis and said latitudinal mounting slots are each arranged to be parallel to said latitudinal axis;

a plurality of mounting openings extending through said mounting surface, wherein said longitudinal mounting slots and said latitudinal mounting slots form a grid pattern and the plurality of mounting openings are located in the center of squares formed within the grid pattern; and a plurality of brackets each for insertion into one or more of said mounting slots, each bracket comprising:

a bracket body having a support extending therefrom;

a bracket opening; and an attachment mechanism including an upper tab and a lower tab extending from said bracket body in a direction opposite of said support, wherein said upper tab and said lower tab are spaced apart so as to fit within two adjacent mounting slots such that the bracket opening aligns with a mounting opening; and a means for securing the bracket to the planar mounting surface using the bracket opening and one of the mounting opening.

10. The storage panel of claim 9, wherein said longitudinal mounting slots are perpendicular to said latitudinal mounting slots.

11. The storage panel of claim 9, further comprising:

one or more mounting openings extending through said mounting surface.

12. The storage panel of claim 11, wherein said longitudinal mounting slots and said latitudinal mounting slots form a grid pattern and the mounting openings are located in the center of each square formed within the grid.

13. The storage panel of claim 9, wherein the spacing between said upper tab and said lower tab is approximately 1 inch on center.

14. The storage panel of claim 9 wherein said means for securing the bracket to the planar mounting surface is a push pin clip.

15. A panel assembly comprising:

a first panel including a mounting surface and an array of spaced apart mounting slots extending through said mounting surface, wherein said array includes a second column of mounting slots positioned nearest to an edge of said first panel and a first column of mounting slots immediately adjacent to said second column of mounting slots;

a second panel including a mounting surface and an array of mounting slots defined through said mounting surface, wherein said array includes a third column of mounting slots positioned near an edge of said second panel and a fourth column of mounting slots adjacent to said third column of mounting slots;

wherein said first panel and said second panel are configured to be mounted such that the edge of said first panel abuts the edge of said second panel; and wherein when said first panel and said second panel are mounted side by side, a distance between said second column of mounting slots and said third column of mounting slots is equal to a distance between said first column of mounting slots and said second column of mounting slots as well as said third column of mounting slots and said fourth column of mounting slots; and a plurality of mounting openings extending through the mounting surface of the first panel and the mounting surface of the second panel, wherein said longitudinal mounting slots and said latitudinal mounting slots form a grid pattern and the plurality of mounting openings are located in the center of squares formed within the grid pattern;

at least one bracket for supporting an object, said bracket having a first end and a second end spaced apart from the first end, wherein the bracket includes:

a first attachment mechanism and a first bracket opening each located adjacent the first end, the first attachment mechanism for engaging with at least one of the mounting slots such that the first bracket opening aligns with one of the mounting openings, and a second attachment mechanism and a second bracket opening each located adjacent the second end, the second attachment mechanism for engaging with at least one of the mounting slots in a different column than that engaged by the first attachment mechanism and such that the second bracket opening aligns with one of the mounting openings different from that which the first bracket opening aligns with; and means for securing the bracket to the planar mounting surface using the first bracket opening, the second bracket opening and the mounting openings.

16. The panel assembly of claim 15, wherein said arrays of mounting slots includes longitudinal mounting slots and latitudinal mounting slots; and wherein said longitudinal mounting slots are arranged to be substantially perpendicular to said latitudinal mounting slots.

17. The panel assembly of claim 15, wherein the distance between said second column of mounting slots and said third column of mounting slots is approximately 1 inch.

18. The panel assembly of claim 15, wherein said first panel includes a support flange extending from the mounting surface of said first panel and wherein said second panel includes a support flange extending from the mounting surface of said second panel; and wherein said support flange of said first panel connects to said support flange of said second panel to attach said first panel to said second panel.

* * * * *